US006896203B1

(12) United States Patent
Restive

(10) Patent No.: US 6,896,203 B1
(45) Date of Patent: May 24, 2005

(54) ASPIRATION SPRAYER

(75) Inventor: Mario J. Restive, Frankfort, NY (US)

(73) Assignee: The Fountainhead Group, Inc., New York Mills, NY (US)

( * ) Notice: Subject to any disclaimer, the term of this patent is extended or adjusted under 35 U.S.C. 154(b) by 281 days.

(21) Appl. No.: 09/688,488

(22) Filed: Oct. 16, 2000

(51) Int. Cl.[7] ..... A62C 13/62; A62C 5/02

(52) U.S. Cl. ..... 239/302; 239/310; 239/311; 239/337; 239/582.1

(58) Field of Search ..... 239/302, 310, 239/311, 337, 354, 369, 428.5, 569, 570, 239/582.1, 8, 355, 368; 222/401, 402.18

(56) References Cited

U.S. PATENT DOCUMENTS

| | | | | |
|---|---|---|---|---|
| 3,831,855 | A * | 8/1974 | Mocarski | 239/416 |
| 4,802,630 | A * | 2/1989 | Kromrey et al. | 239/428 |
| 4,883,086 | A * | 11/1989 | Lejnar | 137/399 |
| 5,100,058 | A * | 3/1992 | Wei | 239/273 |
| 5,107,893 | A * | 4/1992 | Adkins | 137/599.12 |
| 5,180,439 | A * | 1/1993 | Allison | 134/21 |
| 5,323,935 | A * | 6/1994 | Gosselin et al. | 222/401 |
| 5,992,690 | A * | 11/1999 | Tracy | 222/79 |

* cited by examiner

*Primary Examiner*—Davis Hwu
(74) *Attorney, Agent, or Firm*—Brian B. Shaw, Esq.; Stephen B. Salai, Esq.; Harter, Secrest & Emery LLP

(57) ABSTRACT

A low-flow-rate sprayer assembly is provided, wherein additive from a container is entrained in a stream of carrier fluid passing through a venturi. The pressures created by flow through the venturi actuate a release valve on the container and entrain the additive in the carrier fluid.

5 Claims, 5 Drawing Sheets

ASPIRATION SPRAYER

FIELD OF THE INVENTION

The invention relates generally to mixing and dispensing sprayers and more particularly to aspiration type sprayers for use in dispensing a liquid based chemical from a valved container into a carrier fluid.

BACKGROUND OF THE INVENTION

Every year thousands of gallons of chemicals such as fertilizers or pesticides are applied to crops, plants, lawns, flowers, vegetable gardens and other organic type vegetation. Such chemicals are often sold to the consumer in the form of a concentrated liquid, and therefore are extremely hazardous to the consumer end user and environment in general. Accordingly, these concentrated liquids are marketed in sealed valved containers.

However, the need exists for a sprayer that can cooperatively engage the container and entrain the chemicals or solution from the container for dispersion. The need also exists for a sprayer that can employ relatively low flow rates to access and disperse the chemicals from the container.

SUMMARY OF THE INVENTION

The present invention provides a low-flow rate aspirator type sprayer, configured to be removably interlocked with a single-use pre-filled container. The container includes a valve for selectively permitting passage of material from the container. The sprayer is connected to a source of a carrier fluid such as a tank sprayer. A specific configuration of the present invention provides sufficient aspiration at relatively low flow rates to access the material in the container and entrain the material for dispersion.

The sprayer includes a housing, which encloses a passageway having a venturi. The passageway is fluidly connected to a plunger which is moveably connected to the housing between a retracted position and an actuating position. The plunger has a duct there through to provide a path for material from the container to pass to the passageway.

When purchased by the user, the container is sealed by a valving mechanism which is held in a closed position by a bias mechanism, such as a spring. The valving mechanism provides an exit from the container when properly actuated. A dip tube extends from the valving mechanism and is sized to be immersed in the additive until the additive is depleted.

A superstructure of the container has a flange which can interlock with the sprayer housing. With the sprayer and the container interlocked together, the plunger is aligned with the valving mechanism. When water is caused to flow through the passageway and the venturi, a resulting high pressure is created upstream of the venturi constriction, this relatively high pressure is exposed to the plunger to urge the plunger against the valving mechanism to open a flow path from the container to the venturi. The water flow also produces a reduced pressure at the constriction of the venturi which allows an atmospheric pressure acting on the additive in the container to push the additive through the dip tube and into the flow passing through the passageway.

That is, once the plunger is actuated, the pressure differential between the reduced pressure in the venturi and the atmospheric pressure acting on the material (additive) in the container causes the additive to be pushed up through the dip tube, the valving mechanism and the plunger until it enters the stream of carrier liquid in the venturi. This upward flow of additive is driven by the atmospheric pressure above the additive, which is greater than the pressure at the point where the additive exits into the venturi.

The concentrate additive enters the low-pressure area of the venturi and mixes with the water as it flows into the diverging section of the venturi, extension and nozzle tip. At the venturi divergence, the high pressure is restored and is applied through the extension to the nozzle tip. This high pressure at the tip allows for the ability to increase the velocity at the nozzle and provide the shear stresses needed to form droplets in a spray pattern.

The invention, then, provides that the pressure required for the plunger to actuate the valving mechanism of the container is supplied by a relatively high pressure in the flow of carrier fluid resulting from the flow of the carrier fluid through the venturi, eliminating the necessity for a mechanical device to be incorporated into the nozzle.

DETAILED DESCRIPTION OF THE INVENTION

Figure 1:
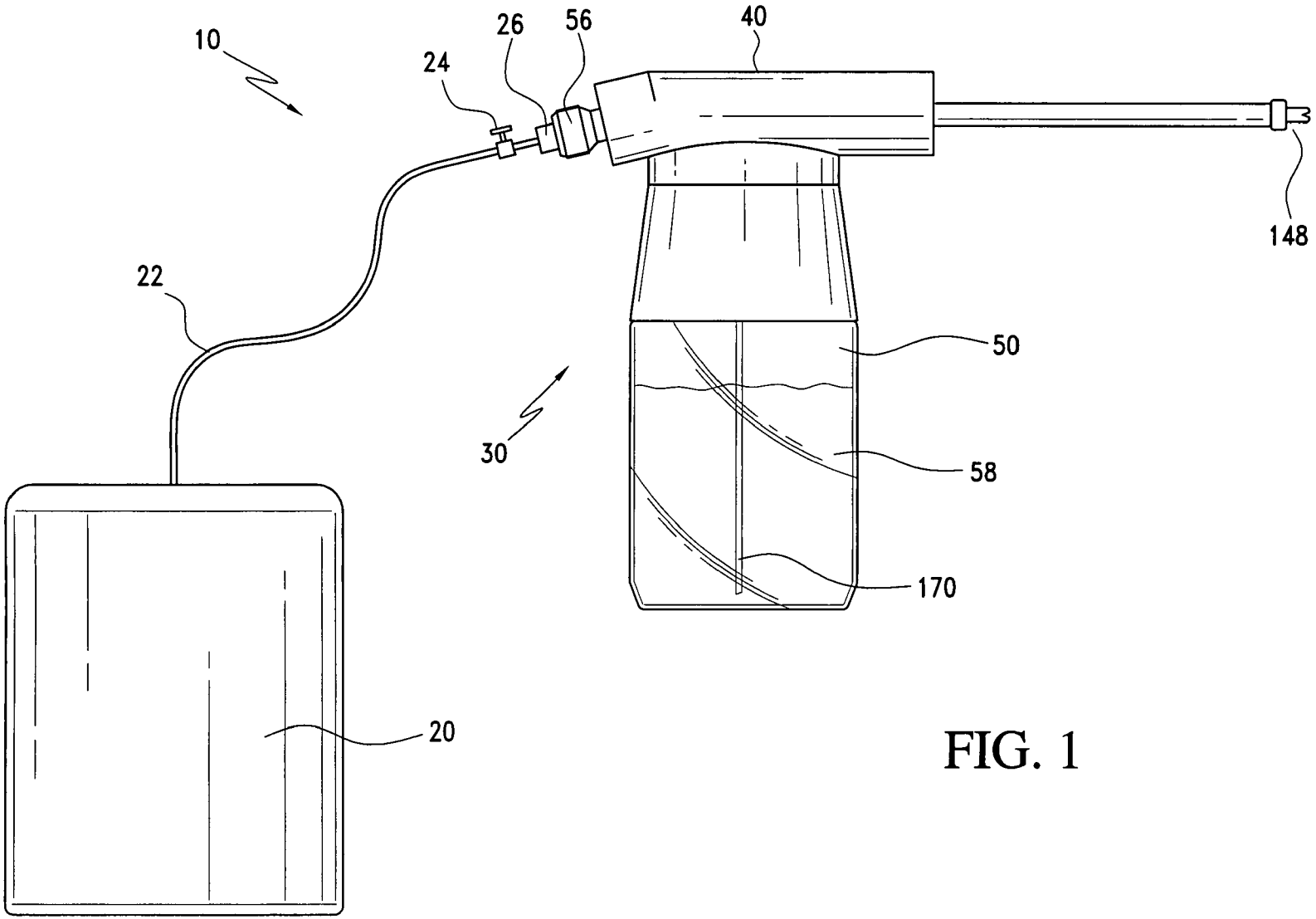
FIG. 1 is a schematic of a spraying apparatus.

Referring to the drawings, a spraying apparatus 10 shown schematically in FIG. 1 includes a fluid source 20 and a sprayer assembly 30. The spraying apparatus 10 cooperates with a chemical container 50 to withdraw and disperse an additive (chemical) 58 from the container 50.

The fluid source 20 is typically a tank which can be pressurized by hand, and also includes flexible hose 22 with a shutoff 24, and a first connector fitting 26. However, it is understood the fluid source 20 may be any of a variety of structures including pack back tanks, hand portable tanks or even tractor transported tanks.

Figures 2, 3:
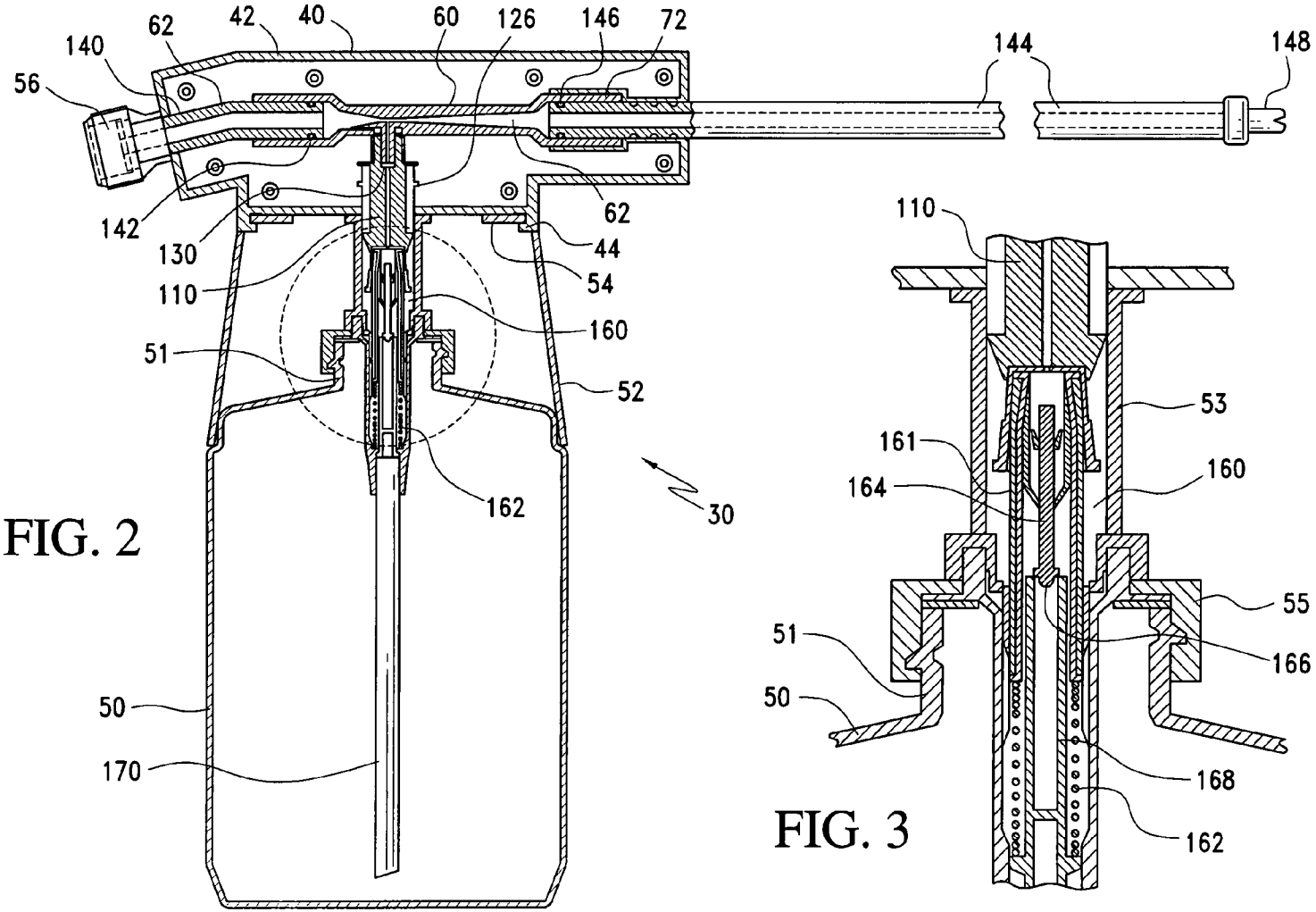
FIG. 2 shows in cross-section a spray assembly in a non-operative position, including a spray nozzle and a container.
FIG. 3 shows a close-up of a portion of FIG. 2.

In the preferred embodiment, the sprayer assembly 30 shown in FIG. 2 cooperates with the container 50 which has a neck 51 enclosed by a superstructure 52. The container 50 includes an interlock portion 54. The container 50 holds an additive (chemical) 58 which, when the sprayer assembly 30 is functioning, is drawn into a fluid stream in the spray nozzle 40 to be diluted to a predetermined degree and sprayed on a selected surface.

The sprayer assembly 30 includes a nozzle 40, having a housing 42 and an interlock flange 44 which releasably engages with the interlock portion 54. A second connector fitting 56 couples with the first connector fitting 26 to provide a fluid-tight joint between the source 20 and the spray nozzle 40.

Figure 4:
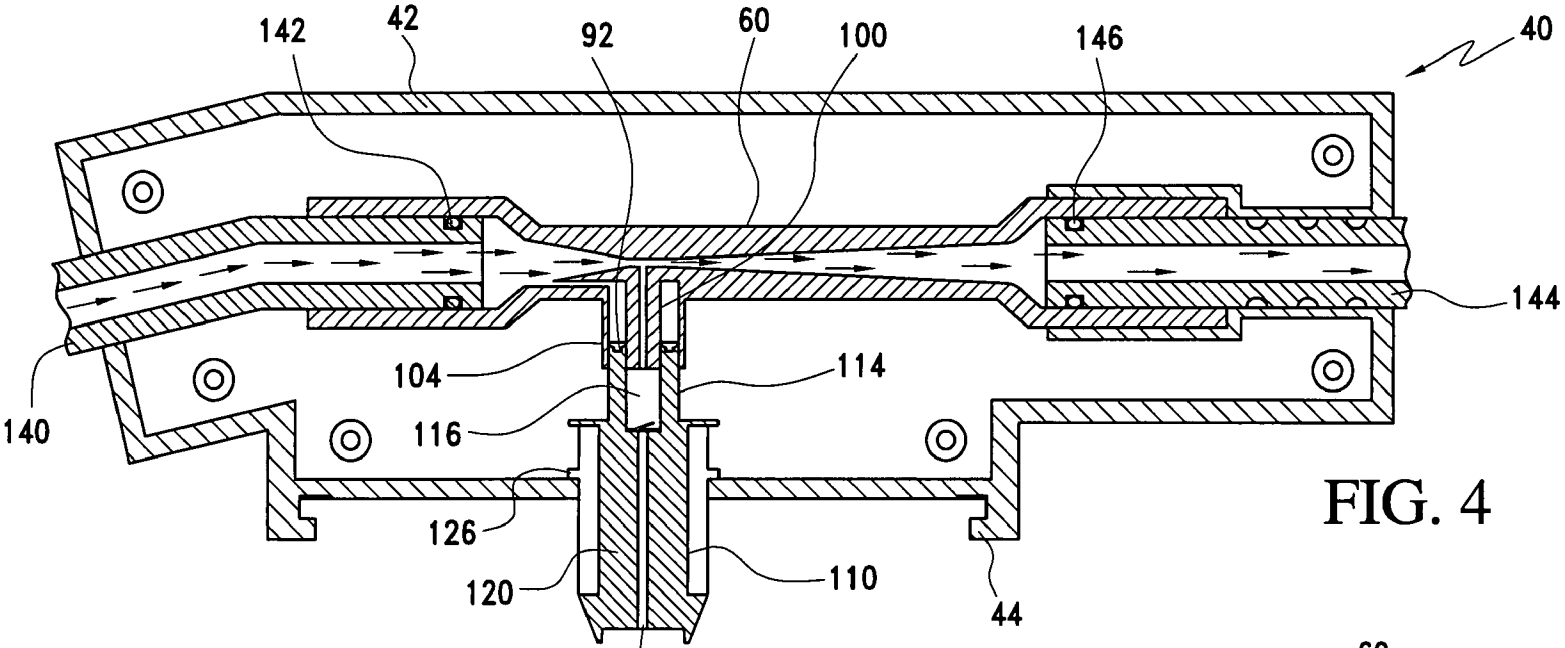
FIG. 4 shows the spray nozzle in cross-section, in an operative position.
Figure 5:
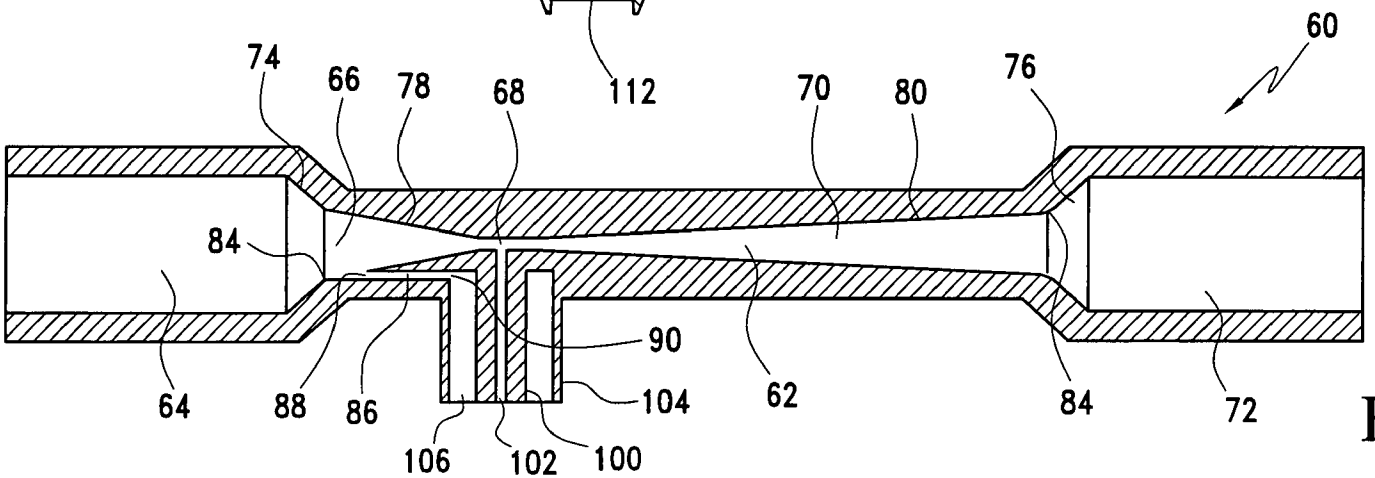
FIG. 5 shows a venturi in cross-section.

An important feature of the sprayer assembly 30 is a passageway 62 including a venturi 60, viewed in the cross-section of FIGS. 4 and 5. A wide entry 64 and a first tapered region 66 lead to a constriction 68, and a second expanding tapered region 70 terminates at an exit 72 which has a similar diameter to the entry portion 64. Each of the tapered regions 66 and 70 has respectively a steeply tapering portion 74 and 76, a less steeply tapering portion 78 and 80, and a corresponding transitional portion 82 and 84 between them. The exact profile of the venturi 60 is determined by the quantitative fluid flow and pressure requirements. Qualitatively, the general characteristics of the venturi 60 provide that fluid which enters at a certain rate must increase its flow velocity as it passes through the constriction 68 and decrease its flow velocity as the passageway 62 widens again. The fluid pressure must correspondingly fall as the flow passes through the constriction 68 and increases again downstream of the constriction. That is, the flow is governed by Bernoulli's equation which states that along a flow line, the static pressure plus dynamic pressure remain constant.

The housing 42 has a depending boss 100, providing an open-ended channel 102 which communicates with the passageway 62, and has a diameter comparable with that of the constriction 68. Concentric with the boss 100 is a skirt 104 which depends from the body of the housing 42, extending approximately the same distance as the boss 100.

Figure 9:
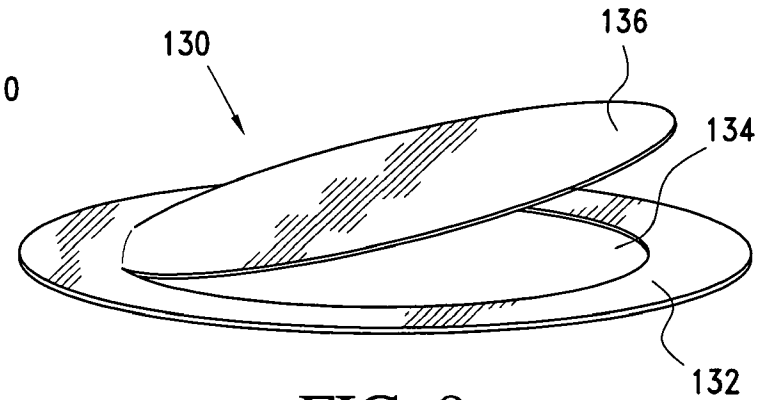
FIG. 9 is a perspective view of a check valve.
Figure 7:
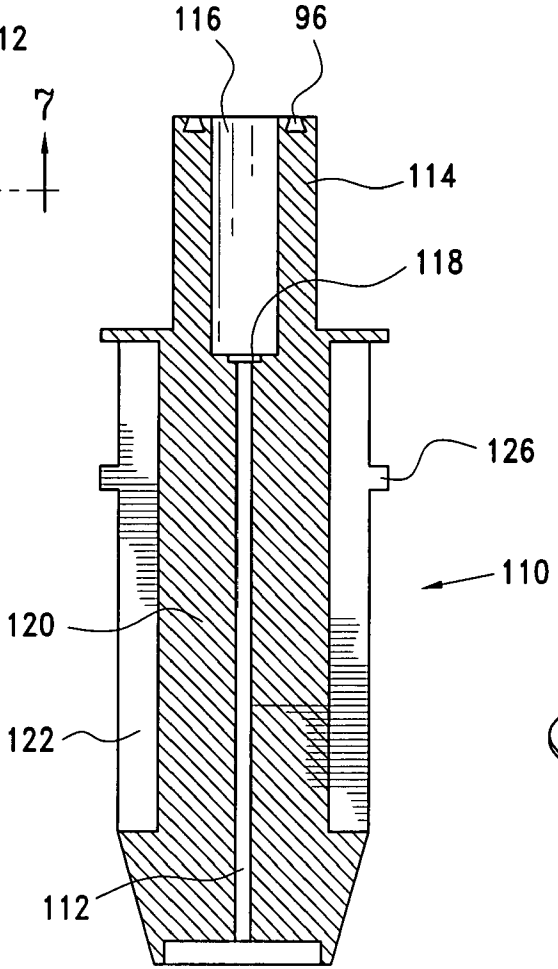
FIG. 7 is a cross section of the plunger taken along line 7—7 of FIG. 6.
Figure 6:
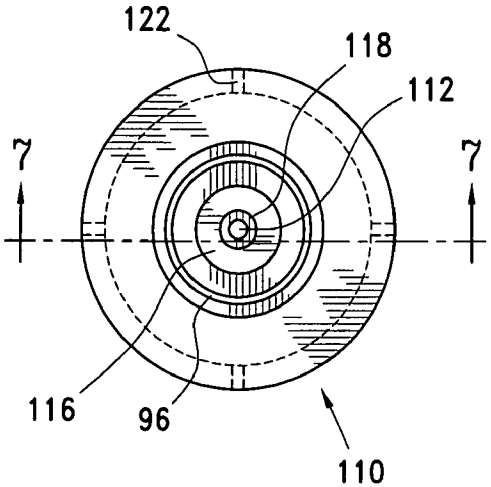
FIG. 6 is a top plan view of a plunger.

A space 106 between the boss 100 and skirt 104 accommodates an actuator or plunger 110, which has a generally cylindrical shape and includes an open-ended axial channel 112, as seen in FIGS. 6 and 7. The plunger is movable between a retracted position and an actuating position. An upper portion 114 of the plunger 110 has a cylindrical cavity 116 and is sized so that it can slidingly engage the housing 42 intermediate the boss 100 and the skirt 104. At the lowest part of the cavity 116 is a seat 118 wherein is located a check valve 130 illustrated in FIG. 9. The check valve 130 has the form of a ring 132 having an aperture 134 and a hinged flapper portion 136. The check valve 130 is biased to a default open position, to permit flow from the sprayer assembly 30 to the container 50.

A lower portion 120 of the plunger 110 has vertical strengthening ribs 122 spaced around its perimeter. Also provided on the lower portion has a stop 126 which limits downward travel of the plunger 110 when it contacts the interior surface of the housing 42, and ensures that the upper portion 114 of the plunger 110 remains intermediate and engaged with the boss 100 and the skirt 104.

A conduit 86 extends from an entry point 88, at a relatively high pressure region of the venturi 60, to an exit point 90 which is inside the space 106, and diverts some of the incoming fluid thereto. In effect, the conduit 86 allows the fluid pressure at the entry point 88 to be transmitted to the plunger 110. The application of this pressure on the plunger 110 urges it downward to actuate the valving of the container 50 in a manner which will become clear. In an alternative configuration, a flexible seal 92 is located to inhibit migration of fluid beyond the plunger 110.

Figure 8:
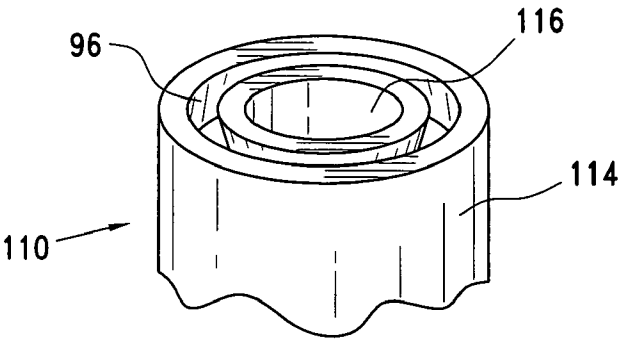
FIG. 8 is a perspective view of a portion of the plunger.
Figure 10:
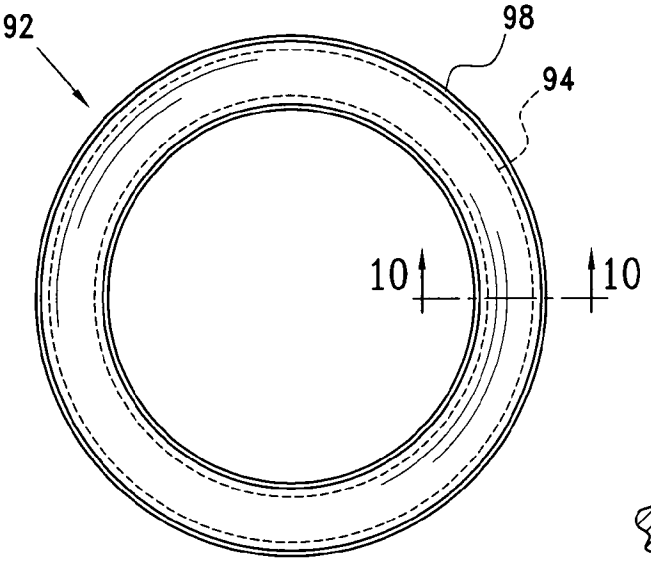
FIG. 10 is a plan view of a flexible seal.
Figure 11:
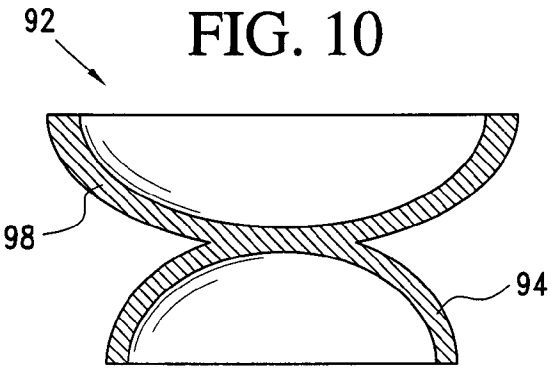
FIG. 11 is a cross-section of the flexible seal taken along line 10—10.

The seal 92 has a generally circular shape when viewed from above, as seen in FIG. 10. When viewed in profile, the seal 92 exhibits a cross-section having the double-cup shape of FIG. 11. A smaller, inverted portion 94 of the seal 92 is sized to be received by a recess 96 which is provided at the upper end of the plunger 110, as best seen in FIGS. 7 and 8. In profile, the recess 96 becomes wider as its depth increases, allowing the inverted portion 94 of the seal 92 to be securely engaged therein. An upper portion 98 of the seal 92, when not constrained has an outer circumference slightly greater than the inside circumference of the skirt 104, and an inner circumference slightly smaller than the outer circumference of the protuberance 100. Both the outer and inner circumferences of the seal 92 are in constant contact with the corresponding surfaces of the venturi 60, and the passage of fluid is precluded thereat, while the plunger 110 remains free to be moved up and down between the retracted position and the actuating position.

Referring to FIG. 2, a carrier fluid input tube 140 passes through the housing 42 and is inserted into the entry portion of the venturi 60, being sealed therein using an O-ring 142. Outside the housing, 42, the input tube 140 terminates at the second connector fitting 56, which couples with the first connector fitting 26 as previously indicated. Similarly, an output tube 144 is sealed in the exit portion 72 using a second o-ring 146. The output tube 144 passes through the housing, beyond which it extends some appropriate distance and terminates at a nozzle tip 148, which can be chosen according to the pattern of spray desired.

Prior to the sprayer 30 being attached to the container 50, the container contents are sealed therein by a valving assembly 160 which is enclosed by a collar 53 of the superstructure 52. As best seen in FIG. 3, the valving assembly 160 extends downward into the container 50 through the neck 51, and is threadedly joined thereto through an intermediate structure 55. When the sprayer assembly 30 is attached to the container 50, the plunger 110 is brought into contact with a movable member 161 of the valving assembly 160 against the opposition of a spring 162. It is not necessary for the purposes of this application to provide a detailed description of the valving assembly 160; however, it is pertinent to indicate that the valving assembly 160 has an outlet valve 164 which is seated in an orifice 166 of an additive inlet tube 168 and acts as a gate. It is displaced upward by additive as it enters through a dip-tube 170 from the container 50, but any back flow is precluded since the concomitant downward pressure would immediately cause the outlet valve 164 to be re-seated in the orifice 166 to provide a seal.

The spray assembly 30 is attached to a carrier fluid source which provides a low flow rate of water, typically in the range up to about 1.5 gallons per minute (approximately 6 liters per minute). In one configuration, the source 20 is a tank sprayer which can be pumped by hand to provide an internal pressure to eject the water, although a garden hose could also be used if a suitable flow limiter were employed.

Operation

To prepare the assembly for use, the container 50 containing additive is locked in position on the sprayer 30, bringing the plunger 110 into contact with the valving assembly 160. In the absence of any further pressure, the opposing force of the spring 162 ensures that the plunger 110 remains in its uppermost, retracted, position. At this point, the sprayer assembly 30 has the configuration shown in FIG. 2, with the plunger stop 126 elevated above the interior surface of the housing 42.

A shutoff 24 at the source 20 is turned on to allow the flow of carrier liquid, water, to commence. As the water passes through the venturi 60, the water from the conduit 86 exerts a relatively high pressure on the upper surface of the plunger 110. The water being at a relatively high pressure corresponding to the position in the venturi 60 where the conduit has its entry point 88, there is sufficient pressure to overcome the opposition of the spring 162 and causes the plunger 110 and the movable member 161 of the valving assembly 160 to be downwardly displaced together to the actuating position, thereby unsealing the container 50 so that additive 58 can exit. The plunger 110 is now in the position illustrated in FIG. 4, the stop 126 being in contact with the interior of the housing 42, which limits further downward travel.

Meanwhile, the water flowing past the constriction 68 has a lower pressure than the interior of the container 50, providing a driving force for the additive 58 to be expelled therefrom. The pressure drop between the container 50 and the area of the constriction 68 causes the outlet valve 164 and the check valve 130 to open, and additive 58 is drawn up through the dip tube 170 and into the venturi 60, wherein it enters the carrier liquid (water) stream and is mixed with the water downstream from the constriction 68. The proportion of additive to water is determined by characteristics of the venturi 60 in a manner which is well known in the art and which is not the subject of this invention.

When no further spraying is required, the shut-off 24 at the source is closed to stop the flow of water through the passageway and venturi. The upward force of the spring 162 is now sufficient to return the movable member 161 and the plunger 110 to their uppermost positions. The outlet valve 164 and the check valve 130 close, and entry of residual water from the venturi 60 into the container 50 is precluded. If the contents of the container 50 are exhausted or are no longer currently required, the container 50 can be separated from the spray nozzle 40, and replaced if desired by another container which has either the same or a different additive.

Figure 12:
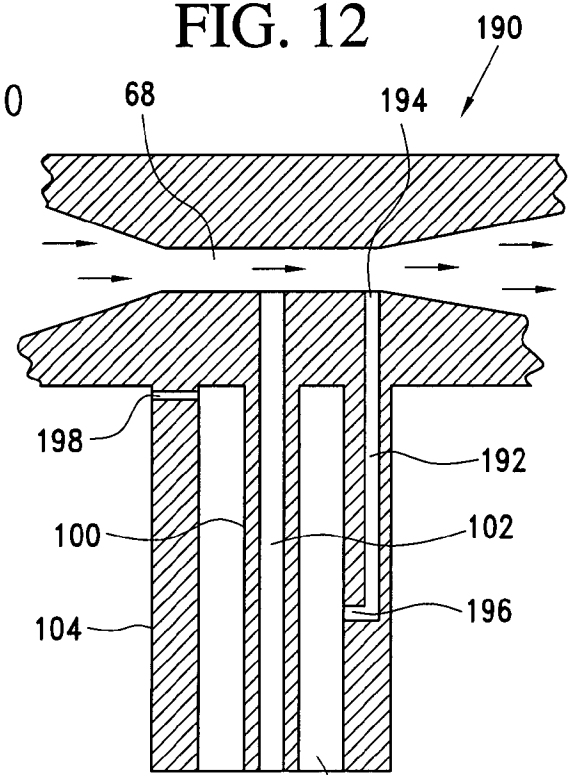
FIG. 12 is a cross-section of a portion of a reconfigured venturi from a second embodiment of the spray nozzle.

In the foregoing preferred embodiment, a positive pressure is communicated from a relatively high-pressure region of the venturi to a portion of the plunger 110, which is thus urged downward to the actuating position. In another embodiment shown in FIGS. 12 and 13, a reconfigured plunger 180 is actuated by a negative pressure communicated from a low-pressure region of a reconfigured venturi 180, shown in FIG. 12. A conduit 192 is provided in the venturi 190 between a low-pressure point 194 and a point 196 at which it meets a part of the space 106 between the protuberance 100 and the skirt 104. A vent 198 passes through the skirt near the top of the space 106. A second seal is also provided on the bottom of the plunger 180.

Figure 13:
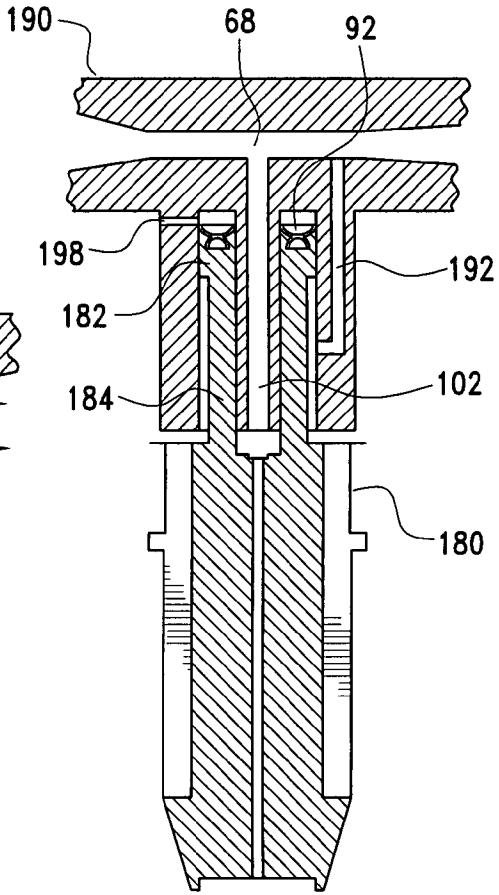
FIG. 13 is a cross-section showing a reconfigured plunger engaged with the venturi of FIG. 12.

FIG. 13 shows the reconfigured plunger 180 slidingly engaged with the venturi 190 in the space 106. The plunger 180 has a sliding portion 182 which is joined to the lower portion 120 by a narrower stem portion 184. The flexible seal 92 is secured to the sliding portion 182 in the same manner as it is attached to the plunger 110 of the first embodiment. The plunger 180 can travel up and down within the space 106 such that the upper and lower limits of travel are between the conduit point 196 and the vent 198.

When the spray nozzle is activated, a low pressure is established at point 194 and transmitted through the conduit 192 to the portion of the space 106 which is below the sliding portion 182. The presence of the vent 198 maintains the portion of space 106 which is above the sliding portion 182 at atmospheric pressure. The resulting pressure difference urges the plunger 180 downward.

The spraying apparatus 10 of the invention has several advantages compared with other low-flow spraying systems. In other spraying systems, additives must frequently be diluted by hand, with the possibility of spills, mistakes and miscalculations. Other tank spraying systems require a mixed additive-water solution to be present in the tank, whereas in the present invention, the tank need contain only water. Rinsing out a tank between uses of different chemicals is much more laborious than the trivial task of purging a small remnant of solution from a spray nozzle. Furthermore, the spray nozzle of the present invention does not require its own shutoff, since flow of additive commences as a result of the pressure differences in the sprayer assembly 30 which only exist when water flows through the venturi. Spraying is simply initiated by operating a shutoff 24 which is already present at the source 20. The absence of an on-off control in the spray nozzle 40 renders it more simple and economical to manufacture.

While the invention has been described in connection with certain embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A sprayer system comprising:

(a) a container;

(b) an outlet valve connected to the container, the outlet valve being movable between an open and a closed position for selectively permitting fluid flow from the container through the outlet valve;

(c) a sprayer assembly attachable to the container, the sprayer assembly including a flow conduit having a venturi;

(d) a plunger in the sprayer assembly fluidly connected to the flow conduit and movable responsive to a flow in the flow conduit between a retracted position and an activating position;

(e) the plunger having an end engaged against the outlet valve and a through channel providing communication from the outlet valve to the venturi; and (f) the outlet valve being movable between closed and open positions responsive to the movement of the plunger respectively to the retracted and activating positions.

2. The sprayer system of claim 1, wherein a positive pressure in the flow conduit is communicated to the plunger for moving the plunger to the activating position.

3. The sprayer system of claim 1, wherein a negative pressure in the flow conduit is exerted on the plunger in response to a flow through the venturi for moving the plunger to the activating position.

4. A sprayer assembly for releasably engaging an additive source having an outlet valve movable between open and closed positions for starting and stopping flow from the additive source, the sprayer assembly comprising:

(a) a housing having a venturi, the housing configured to engage the additive source, the venturi having a positive pressure point and a reduced pressure point;

(b) an actuator sized to contact the outlet valve, moveably connected to the housing between an actuating position and a closed position, and fluidly connected to the one of the positive pressure point and the reduced pressure point to be urged away from the venturi to the actuating position and against the outlet valve in response to a flow through the venturi, the actuator having a through channel providing fluid communication from the outlet valve to the venturi; and (c) the outlet valve moving to the open position in response to the movement of the actuator to the actuating position.

5. A sprayer assembly for engaging an additive source having an outlet valve movable between open and closed positions, comprising:

(a) a housing having a venturi configured to generate sufficiently reduced pressure to entrain an additive at a flow rate less than 1.5 gpm through the venturi;

(b) a plunger moveably connected to the housing between a first position proximal to the venturi and a second position spaced from the venturi in response to a flow through the venturi, the plunger moving from the first position to the second position in response to a flow through the venturi and the plunger having an end engageable with the outlet valve, the plunger including a passageway therethrough connecting the additive source to the venturi;

(c) a check valve fluidly connected to the passageway in the plunger; and (d) the outlet valve being movable to the open position responsive to the movement of the plunger to the second position.

* * * * *